United States Patent [19]

Tews

[11] 4,250,844

[45] Feb. 17, 1981

[54] TWO-CYCLE ENGINE AND PISTON

[76] Inventor: Jan H. Tews, 47 McGuinness Blvd., Brooklyn, N.Y. 11222

[21] Appl. No.: 27,453

[22] Filed: Apr. 5, 1979

[51] Int. Cl.[3] ..... F24B 13/04

[52] U.S. Cl. ..... 123/73 AV; 123/47 A; 123/73 R; 417/550

[58] Field of Search ..... 123/47 A, 47 R, 73 AV, 123/73 R, 75 CC, 75 RC, 73 AA, 74 R; 417/550, 545; 91/222, 422, 24, 25, 26

[56] References Cited

U.S. PATENT DOCUMENTS

| | | | |
|---|---|---|---|
| 803,078 | 10/1905 | Thompson | 123/73 AV |
| 1,451,033 | 4/1923 | Todd | 417/550 |
| 2,000,883 | 5/1935 | Cullen et al. | 417/550 |
| 2,089,630 | 8/1937 | Teeter | 417/550 |
| 3,645,651 | 2/1972 | Bills | 417/550 |
| 3,961,868 | 6/1976 | Droege, Sr. et al. | 417/550 |
| 4,112,882 | 9/1978 | Tews | 123/47 A |

*Primary Examiner*—Wendell E. Burns
*Attorney, Agent, or Firm*—Morgan, Finnegan, Pine, Foley & Lee

[57] ABSTRACT

An improved two-cycle internal combustion engine with a novel intake, exhaust and piston arrangement in which a fresh charge for combustion component is advantageously transferred through the piston and all valves in the engine operate in response to changes in dynamic pressure generated within the engine. The piston includes at least one charging passage through its top surface with a pressure sensitive valve affixed to the top surface of the piston for preventing flow of a fresh charge through the charging passage in the absence of a greater pressure differential caused by the intake charge against the undersurface of the pressure sensitive valve. Advantageously, the pressure sensitive valve is deflected upwardly to provide passage of a charge through the charging passage in the presence of a sufficient pressure differential caused by the intake charge acting against the undersurface of the pressure sensitive valve, and the charging passage and pressure sensitive valve coact to direct flow of the incoming charge toward the walls of the engine cylinder away from the exhaust. Also advantageously, the intake and exhaust can be directly controlled by the piston.

24 Claims, 16 Drawing Figures

TWO-CYCLE ENGINE AND PISTON

BACKGROUND AND OBJECTS OF THE INVENTION

The present invention relates generally to two-cycle engines and more particularly to certain new and useful improvements in the intake, upper cylinder charging and the exhaust systems of two-cycle engines which may be manufactured at low cost with relatively few and substantially simple operating parts, while increasing engine life and offering more efficient and consistent power outputs at high and low speeds and high and low compression than in two-cycle engines heretofore known. As will become evident from the description of the invention, the invention has applicability to two-cycle engines wherein combustion is effected by either electrical spark or diesel effect.

Previously known two-cycle engines generally comprise cylinder housings enclosing one or more engine cylinders, each formed with a fuel transfer passage external of the cylinder to provide an access conduit for transferring fuel, which has been compressed in the crankcase, from the crankcase into the combustion chamber. Each engine cylinder contains a piston, slidable therein, which is generally formed with a port in its side for registering with one end of the fuel transfer passage to allow flow into the combustion chamber. In accordance with some of these known engine configurations, when the piston port and transfer passage are in registration, either in whole or in part, fuel passes from the passage into the piston itself for discharge into the combustion chamber through an open nozzle in the piston. In accordance with other known engine constructions, when the piston port and transfer passage are in registration, fuel flows from the piston port into the entrance of the transfer passage which exits in the combustion chamber.

Although these known engine constructions have proved adequate for low speed operation and low compression adaptations, the complexity of the cylinder, housing and piston structures necessitates multiple and intricate fabrication techniques to which high manufacturing costs are attributable. Furthermore, these engines experience significant flow losses in charging the combustion chamber and have a relatively low efficiency and power output. For example, the relatively short period of time that the piston port and transfer passage are in registration-either in whole or in part-as well as the dimensions of the fuel transfer passage limit the charging of the combustion chamber such that reliable and proper charging cannot be assured. Furthermore, the piston structures are generally heavy or provided with very complex surfaces, thereby reducing the output of the engine. These considerations are significant in reducing power output and preventing higher efficiency, especially at high speed operation or in high compression operation adaptations.

Other known two-cycle engine constructions are provided with pistons formed with projections or other irregular structures protruding into the combustion chamber to guide incoming flow from transfer or bypass channels. Such structures complicate fabrication and are susceptible to damaging as a result of local overheating, thereby shortening the useful life of the engine.

One prior art two-cycle engine construction utilizes a piston formed with an inlet port on its top surface, controlled by a pressure operated valve. An example of this engine is disclosed in U.S. Pat. No. 1,082,402 to Campbell. Although such engines may offer certain advantages, they are usually complicated with cams, lifters and heavy spring-loaded valves. Consequently, these engines have not proved to be efficient and generally suffer from power output losses, especially at high speed and/or high compression operation.

However, none of these known constructions provide for introducing an adequate charge for combustion into the combustion chamber throughout their range of operation. Moreover, no two-cycle engine has been developed which provides a mechanically simple and relatively inexpensive means for assuring proper and reliable charging of the combustion chamber in engines operating at high and low speeds and high and low compression, to generate consistently high efficiency and high power output in all such ranges of operation. Furthermore, no two-cycle engine has been eveloped which is capable of long life and extended use in high speed and/or high compression applications.

It is therefore an object of the present invention to provide a new and improved two-cycle engine.

It is another object of the present invention to provide an improved fuel and/or air intake, charge introduction and exhaust system in two-cycle engines.

It is still another object of this invention to provide a mechanically simple two-cycle engine capable of higher power output and efficiency than heretofore achieved.

It is also an object of this invention to provide a new two-cycle engine capable of easy and inexpensive fabrication.

It is still another object of the present invention to provide a new piston assembly for use in two-cycle engines, which controls the fuel and/or air intake, the introduction of a fresh charge into the combustion chamber and the exhaust of burned gases.

It is also an object of the present invention to provide a charge introduction system for use in two-cycle engines whereby the piston is cooled to allow use for extended periods of time.

It is yet another object of the present invention to provide a light piston for higher output and efficiency than heretofore achieved in two-cycle engines.

It is a further object of the present invention to provide a two-cycle engine free from extra-cylinder air or air/fuel passages.

It is another object of the present invention to provide a two-cycle engine having relatively few moving parts.

It is yet another object of the present invention to provide a two-cycle engine wherein fuel is evaporated to ensure good mixture formation while the piston is simultaneously cooled.

It is still another object of the present invention to provide a two-cycle engine capable of efficiently generating reliable power output at high and low speeds of operation and high and low compression.

It is yet a further object of the present invention to provide a structurally simple two-cycle engine capable of use for extended periods of time at high speed and/or high compression operation.

These and other objects, features and advantages of the present invention will become more apparent when the detailed description of the preferred embodiments is considered in light of the drawings.

The invention consists of the novel parts, constructions, arrangements, combinations and improvements herein shown and described.

SUMMARY OF THE INVENTION

Briefly, the two-cycle engine according to the present invention comprises an engine block which houses a crankcase and at least one engine cylinder adjacent a crankcase. The engine cylinder is partitioned into an upper portion including the combustion chamber and a lower portion including the crankcase by a piston assembly slidable therein. The upper cylinder portion is formed with an exhaust port positioned just above the top of the piston at its lower deadpoint and the lower cylinder portion is formed with an intake port which may be operated by the piston itself or by a pressure sensitive valve.

The piston assembly comprises a generally hollow piston formed with at least one charging passage in its top surface providing communication between the lower cylinder and the combustion chamber for introducing a fresh charge of air and/or fuel into the combustion chamber. Each passage is controlled by a membrane-like valve rigidly affixed to the top of the piston in a cantilever fashion so as to be sensitive to changes in pressure. Advantageously, each charging passage is formed with an angularly outward slant through the top of the piston and the membrane valve is attached so that it opens in the same direction as said angularly outward slant so that they coact to direct the incoming flow toward the cylinder wall away from the exhaust ports. Also advantageously, the piston may be formed with a plurality of relatively small, closely grouped charging passages controlled by valves such that one membrane valve controls at least one group of passages.

Advantageously, the intake port is formed in the wall of the lower cylinder piston and is controlled by the piston for providing the initial intake of air and/or fuel from a carburetor or other suitable source. As here preferably embodied, the intake port may be positioned just below the top of the piston at its lower deadpoint and the exhaust port is formed in the upper cylinder wall slightly above the top of the piston at its lower deadpoint. Thus, both the intake port and the exhaust port are closed during most of the piston travel except when the piston nears one of its deadpoints.

In operation, as the piston rises toward its upper deadpoint during its return stroke, it generates a vacuum in the lower cylinder whereby air and/or fuel is drawn in from a carburetor or other suitable source through the open intake port. After ignition of the previous combustible charge in the combustion chamber, the piston is forced downwardly toward its lower deadpoint, ending the vacuum effect in the lower chamber, and closing the intake port, creating a closed lower chamber wherein the dropping piston compresses the fresh contents thereof.

A point is reached at which the pressure generated by the expanding gases in the combustion chamber is in substantial equilibrium with the pressure of the compressed contents in the lower cylinder so that the pressure in the lower chamber begins exceeding that in the upper cylinder. This pressure differential causes the pressure sensitive valve on the piston head to open and allow introduction into the combustion chamber of the fresh charge of air or air/fuel mixture from below.

When the piston nears its lower deadpoint at the end of its power stroke, the exhaust port is exposed by the piston, whereby the burned gases from combustion are vented to the exhaust as well as being forced out by the circulation of the incoming charge. In addition, the open exhaust port relieves the residual pressure in the combustion chamber to allow entry of a full charge.

At the piston's lower deadpoint, the pressures in the two chambers are again in substantial equilibrium so that, as the piston rises on its return stroke, a slightly greater pressure from above causes the valve to close. The piston quickly closes the exhaust port and begins compressing the charge now contained in the combustion chamber until it reaches its upper deadpoint at which time the cylinder is fired either by an electrical spark or by the injection of fuel according to the diesel effect. Accordingly, as the piston traveled toward its upper deadpoint, the intake step was repeating, as described above, for continuous operation of the engine.

Advantageously, the piston may be formed with three groups of charging passages generally near the outer circumference of its top surface and a solid sector at least equal in width to the width of the exhaust port. Also advantageously, a multi-layered single membrane valve of a generally clover-leaf configuration may be used for controlling the three groups of passages.

In other embodiments of the two-cycle engine of the present invention, the intake port is formed in the wall of the crankcase and controlled by a pressure-sensitive valve attached thereto.

In yet other embodiments of the invention, the piston may be formed with a plurality of charging passages formed in a circumferentially outer zone and controlled by a thin disc-like membrane valve "hinged" between the piston top and a piston head. The piston head is formed with a plurality of rib members to restrict movement of the valve and with a plurality of dispensing ports adapted to direct the flow of the incoming charge toward the cylinder walls and away from the exhaust port. In addition, the engine cylinder and the crankcase may be separated, the piston and piston rod elongated for use as a large two-cycle engine such as those aboard marine vessels.

Two-cycle engines embodying the foregoing constructional features are significantly improved over previously known constructions in reliability of performance, long life, higher outputs and efficiency, simplified fabrication and repair, and lower costs thereof.

It has been found that two-cycle engines constructed in accordance with the principles of the present invention do not require fuel transfer passages or other extra-cylinder crankcase ventilation ducts for directing a fresh charge of air and/or fuel into the combustion chamber, avoiding the normally attendant flow losses. Moreover, consistent introduction of a full fresh charge into the compression chamber is assured with substantially no loss of the fresh charge for all speeds of operation and in all adaptations of compression. The power output of engines utilizing the improved charge introduction system according to the present invention is increased by about 20% over that of comparable dimensioned two-cycle engines heretofore known, with a significant reduction in fuel consumption. In addition, the intake of the fresh charge, its introduction into the combustion chamber and the exhaust of burned gases is substantially totally dependent upon differences in dynamic pressure generated within the engine during its operation. Accordingly, the flow controlling valves are subjected to substantially little stress for increased useful life.

It has also been found that the charge introduction system and the engine structure according to the present invention provides a circulatory charge flow in the combustion chamber whereby substantially all of the burned gases are driven from the combustion chamber and replaced by the fresh charge with negligible loss thereof. In addition, by providing charge transfer through the piston, the piston is cooled by the flow of the charge therethrough, and, if the charge contains a fuel component, the fuel is evaporated by the hot piston to improve combustion.

The two-cycle engine according to the present invention is structurally less complicated and less expensive to fabricate than two-cycle engines heretofore known. It has relatively few moving parts for long engine life and easy repair. Moreover, the piston assembly according to the present invention is relatively light yet, due to the size and spacing of charging passages, it maintains the structural integrity of a solid-top piston for translating the full force of combustion to the crankshaft.

Furthermore, in adaptations of the present invention to large high compression engines, such as those used aboard marine vessels, the use of turbo-blowers for force feeding air into the lower engine cylinder is obviated. Thus, the high costs of such devices as well as the power losses attributable thereto are eliminated, providing an increase in power output and improved fuel consumption.

It should be understood that the foregoing general description and the following detailed description are exemplary of the invention and not restrictive thereof.

The accompanying drawings, referred to hereinafter illustrate preferred embodiments of the invention and, together with the detailed description, serve to explain the principles of the invention.

DETAILED DESCRIPTION OF THE PREFERRED EMBODIMENTS

Figures 1A, 1B, 1C:
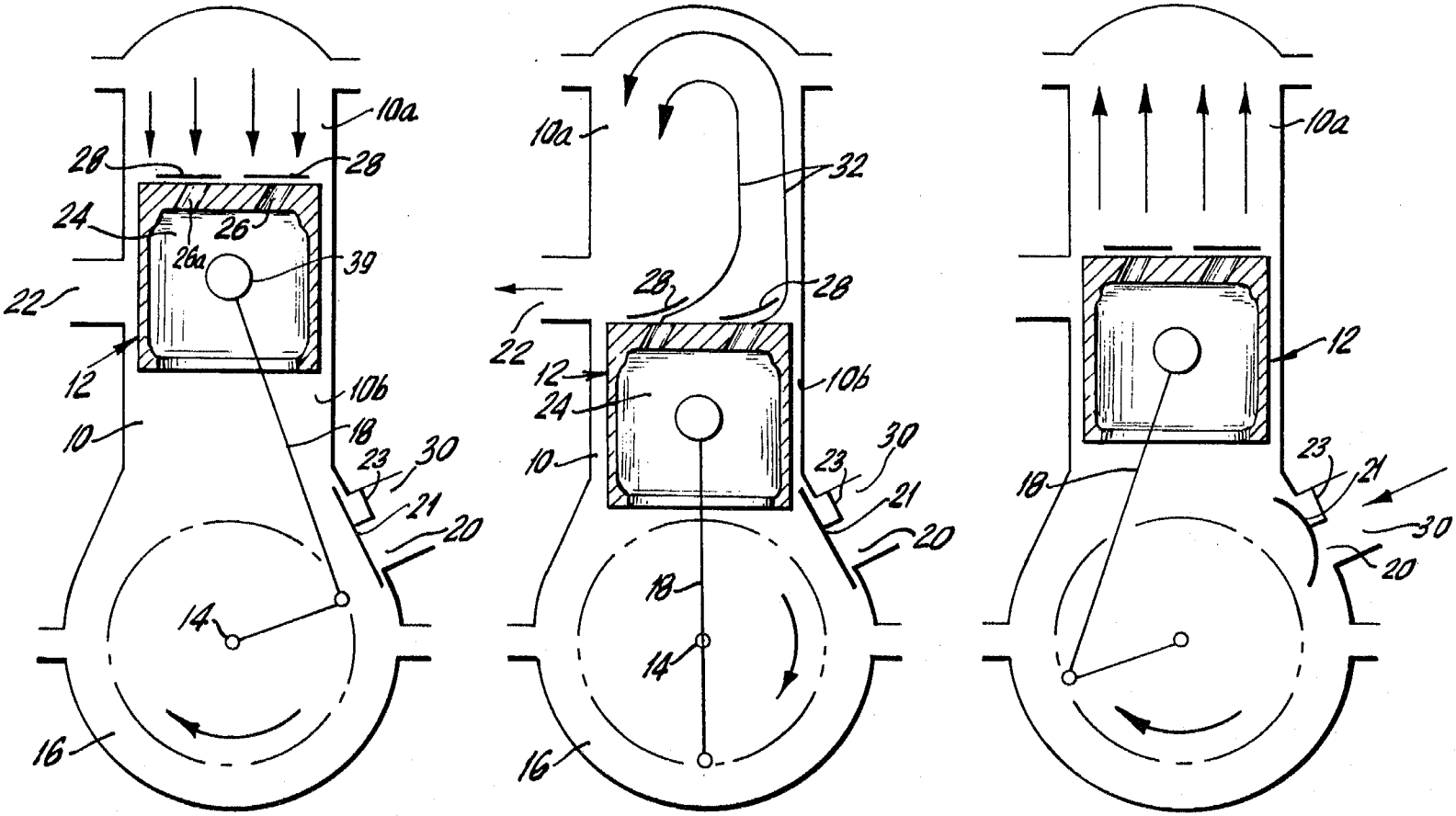
FIGS. 1*a–d* are schematic representations illustrating several aspects of the present invention.

Referring generally to FIGS. 1*a–d*, certain aspects of the present invention are illustrated schematically. FIGS. 1*a–d* show engine cylinder 10 which comprises essentially upper cylinder portion 10*a* and essentially lower cylinder portion 10*b*, separated by piston assembly 12, slidable therein. Piston 12 is connected to crankshaft 14, which is rotatably mounted in crankcase 16, by connecting means 18 rotatably mounted to crankshaft 14 and pivotally mounted to piston 12 for translating linear movement of the piston to rotation of the crankshaft. Connecting means 18 may be any conventional crankshaft-piston rod connector. Crankcase 16 and cylinder 10 may be spatially united as shown generally in FIGS. 1*a–d* for use in relatively small two-cycle engines such as in motorcycles or outboard marine engines, or they may be two independent chambers as disclosed more fully with reference to FIGS. 6*a–d*.

As shown in FIGS. 1*a–c*, intake port 20 may be formed in the wall of the crankcase 16 for the initial intake of a fresh charge of air and/or fuel from a carburetor or other source thereof (not shown) and controlled by means of a pressure sensitive valve 21 connected in cantilever fashion to the inside wall of crankcase 16. Advantageously, valve 21 may be a single sheet of resilient material, such as spring steel, and connected at its center to structural projection 23 in intake port 20 so as to be substantially sensitive to pressure variations. Exhaust port 22 is formed in the wall of the upper cylinder portion 10*a*, so as to be controlled by piston 12. Advantageously, exhaust port 22 may be located such that its bottom is positioned slightly above the top of piston 12 at its lower deadpoint but above the bottom of piston 12 at its upper deadpoint, as shown generally in FIGS. 1*a–d*. Thus, upper cylinder 10*a* is a closed chamber during most of the piston stroke so that only burned gases escape through the exhaust port with minimal, if any, loss of an incoming fresh charge.

Piston 12 is slidably positioned within cylinder 10, sealingly engaging the walls of the cylinder such that the volume of the two chambers, 10*a* and 10*b*, is continuously changing during operation of the engine. The piston 12 is generally hollow, having central cavity 24 substantially open at its bottom to lower portion 10*b* of the cylinder. The top surface of the piston is formed with at least one charging passage 26 for providing communication between central cavity 24 and therefore the lower cylinder portion 10*b* and upper cylinder portion 10*b*. Passage 26 is controlled by a substantially pressure sensitive membrane-like valve 28 affixed in cantilever fashion to the piston top with its free end opening away from exhaust port 22 to direct flow of the incoming charge toward the cylinder wall, driving out essentially all burned gases through exhaust port 22 with no appreciable loss of the fresh charge. Advantageously, valve 28 may be a flap valve comprising a substantially thin sheet of resilient heat resistant material such as spring steel. Also advantageously, passage 26 may be formed on an angularly outward slant to aid valve 28 in deflecting incoming flow towards the cylinder walls and enhance scavenging of the cylinder by driving burned gases through exhaust port 22, as shown in FIG. 1*b*, with essentially no appreciable loss of the fresh charge.

Figure 2A:
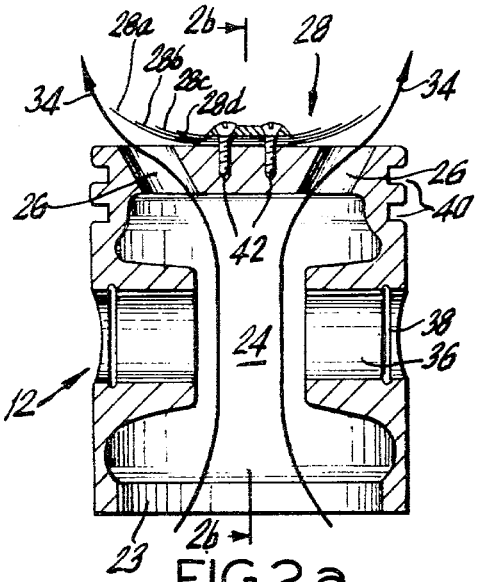
FIGS. 2*a–b* are two side views of a piston assembly according to one aspect of the present invention.

Advantageously, valve 28 may be formed with multiple layers of successively shorter, substantially identical, valve members, such as 28*a*, 28*b*, etc. illustrated in FIG. 2*a*, affixed to the top of piston 12 by at least two screws 42 made of a highly thermally resistive material. Accordingly, each upper valve member supports its bottom counterparts, as in a leaf spring, to provide resiliency to the valve and enhance the seal between valve 28 and the top of piston 12. Advantageously, attachment by two screws simplifies assembly as well as replacement of damaged or worn valves and prevents horizontal movement of the valve.

Referring now to FIGS. 1*a–d*, operation of a two-cycle engine according to one aspect of the instant invention as well as the advantages incident thereto can be appreciated. When piston 12 is positioned intermediate its upper and lower deadpoints as shown in FIG. 1*a*, exhaust port 22 is closed and both upper and lower chambers, 10*a* and 10*b*, respectively are substantially closed chambers. Thus, as piston 12 begins rising towards its upper deadpoint, either during start-up or as part of its return stroke, a vacuum is generated in the lower portion 10*b* of the cylinder, including the crankcase. Pressure sensitive intake valve 21 is opened under the influence of this vacuum and air and/or fuel is drawn through intake port 20 and into the crankcase from a carburetor or other suitable source (not shown) connected thereto by intake conduit 30.

When piston 12 reaches its upper deadpoint, the vacuum in the lower portion of the cylinder substantially ceases and intake valve 21 closes. Essentially simultaneously, the now-compressed previous charge of combustible mixture in the upper portion of the cylinder is ignited by either an electrical spark mechanism or the injection of diesel fuel, the force of combustion driving the piston downwardly on its power stroke, into the still closed lower chamber 10*b*. As the piston travels downwardly towards the lower deadpoint, it compresses the fresh charge just drawn into the lower portion 10*b* of the cylinder while allowing the burned gases in the upper cylinder to expand, relieving their pressure.

A point is reached at which the pressure generated by the expanding gases in the combustion chamber is in substantial equilibrium with the pressure of the compressed charge in the lower chamber. As the momentum of piston 12 carries it downwardly, its influence on the constituent(s) of the lower chamber tends to generate a greater gas pressure below the piston than above. Thus, depending on its resiliency, flap valve 28 is forced open at its free end and the fresh charge begins entering upper cylinder 10*a* and circulating therein as shown schematically in FIG. 1*b*.

As piston 12 continues downwardly on its power stroke, the gas pressure generated by the still expanding burned gases in upper chamber 10*a* continues to be relieved while the remaining charge in lower chamber 10*b* continues to be forced through charging passage 26 due to the tendency toward increased pressure imparted by piston 12 on its work stroke. Thus, the system within the closed cylinder is self-relieving by virtue of the piston assembly until the top of piston 12 drops below the top of exhaust port 22.

When the top of the piston drops below the level of exhaust port 22, the expanding burned gases in cylinder 10*a* escape therethrough, further relieving the pressure in the upper cylinder 10*a*, allowing the full fresh charge to fill upper cylinder 10*a*. Furthermore, the circulation of the entering flow enhances the evacuation of expended gases from the combustion chamber by circulating therein to drive them out through exhaust port 22, as shown by arrows 32, with negligible loss of the incoming fresh combustion charge.

When piston 12 reaches its lower deadpoint, the pressures in the two chambers 10*a* and 10*b* are in substantial equilibrium, such that, as piston 12 begins its return stroke, valve 28 is urged closed and residual burned gases are driven out of the cylinder 10*a*. After having travelled a distance equal to the height of exhaust port 22, upper portion 10*a* of the cylinder is sealed as a closed chamber in order that the charge contained therein may be compressed. Initially, as piston 12 moves upwardly, the tendency towards compressing the contents of upper portion 10*a* ensures secure closure of valve 28. Thus, as explained above, piston 12 travels upwardly as a movable partition between two closed but volume-changing chambers. When piston 12 reaches its upper deadpoint, the charge in chamber 10*a* is fully compressed and ignited either by an electrical spark to an air/fuel misture or by injection of fuel to compressed air according to conventional diesel engine principles while the intake cycle is being repeated for continuous operation of the engine.

Figure 1D:
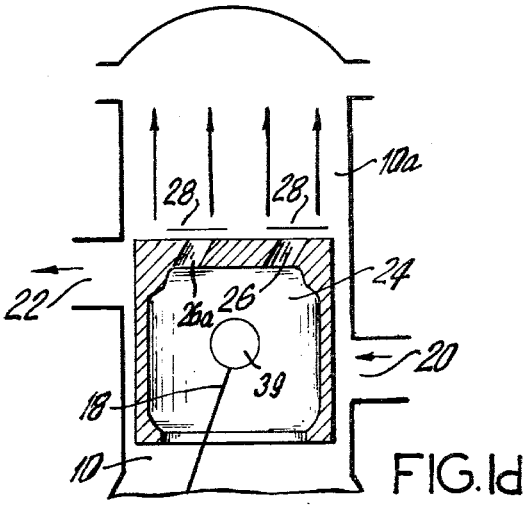

Alternatively, intake port 20 may be formed in the wall of lower cylinder 10*a*, as shown in FIG. 1*d*, so as to be controlled by piston 12. Advantageously, the top of intake port 20 is formed slightly below the top of piston 12 at its lower deadpoint but below the bottom of piston 12 at its upper deadpoint. Thus, as piston 12 returns to its upper deadpoint, a vacuum of increasing strength is generated to lower cylinder 10*b*, also drawing valve 28 downwardly to enhance its seal with piston 12. When the bottom of piston 12 exposes port 20, the vacuum in cylinder 10*b* is relieved by drawing in a fresh charge of air and/or fuel through intake passage 30, this intake step continuing until the piston reaches its upper deadpoint. The force of combustion drives piston 12 downwardly on its power stroke, to close port 20 and begin compressing the fresh charge in cylinder 10*b* whereinafter the engine operates substantially as described with respect to FIGS. 1*a–c*. This configuration is particularly useful since, once the fresh charge has been drawn in through port 20, piston 12 closes it off to prevent the charge from escaping back therethrough as the falling piston begins compressing it on the work stroke.

Figure 2B:
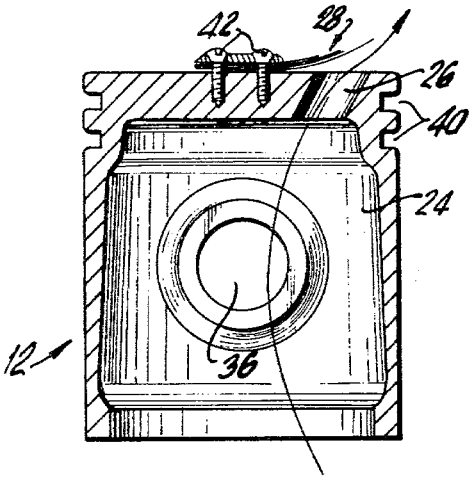

Referring now to FIGS. 2*a* and 2*b* (which is a view along section 2*b*—2*b* of FIGS. 2*a* and 3*a*), there is shown a particularly useful piston assembly according to the present invention. Cavity 24 is formed substantially central to piston 12 connecting its bottom opening 23, and therefore lower cylinder 10*b*, to a plurality of charging passages 26 in the top of piston 12. Recesses 40 are formed on the sides of piston 12, near its top, to retain seal rings (not shown) for sealingly engaging the walls of the engine cylinder in substantially fluid-tight fashion for the range of pressures to be generated within the engine. Piston 12 may be pivotally connected to shaft 18 by any conventional means such as pivot rod 39 fitted within bore 36 and held by pins 38.

Charging passages 26 are formed with an angularly outward slant generally near the outer periphery of the piston, away from the center, to direct the incoming charge directly at the cylinder walls for ensuring substantially thorough scavenging of burned gases while providing a support section generally central of the piston top to permit attachment of the membrane inlet valve 28. Advantageously, piston 12 is formed with at least one groups of relatively small, essentially closely spaced charging passages 26 to provide adequate access to upper cylinder 10*a* for the fresh charge contained in lower cylinder 10*b*.

Advantageously, a single pressure sensitive valve 28 is rigidly affixed by one end like a flap to the top of the piston, as by screws 42, to control at least one group of charging passages. In a particularly useful embodiment, the flap valve is formed by successively shorter, generally identical valve members, 28*a*, 28*b*, 28*c*, etc., with each layer supporting its lower counterparts as in a leaf spring to add resiliency.

Figure 3B:
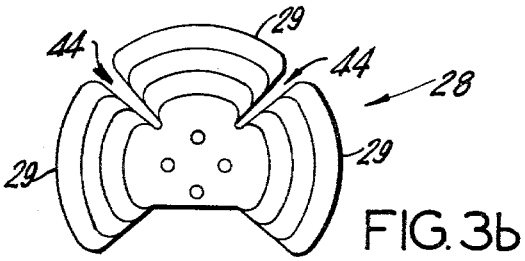
FIGS. 3*a–b* are top views of a piston head and associated membrane valve according to one embodiment of the present invention.
Figure 3A:
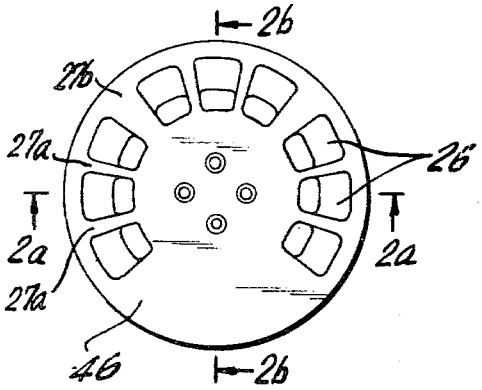

Referring now to FIGS. 3*a–b*, there is shown a particularly useful embodiment according to this aspect of the present invention, wherein three groups of three charging passages 26 are formed in piston 12. Advantageously, passages 26 are relatively small as compared to the piston top area to maintain its structural integrity. Each passage within a group is separated from an adjacent passage by structural member 27*a* and each group of passages is separated from an adjacent group by a generally wider structural member 27*b*. Advantageously, membrane valve 28 may be generally circular with radially inward cut-outs 44 to form a generally clover-leaf valve as shown in FIG. 3*b*. Also advantageously, valve 28 may be formed in a multi-membered configuration, as described with reference to FIG. 2*a*, comprising a plurality of successively shorter, generally identical valve members. Cut-outs 44 generate valve sections 29, each controlling one group of passages 26 substantially independently such that valve 28 is substantially sensitive to pressure variations.

This configuration is particularly advantageous since structural members 27*a* support each valve section 29 from below to enable it to withstand the force of combustion and transfer it substantially undiminished to the crankshaft as if piston 12 were formed with a solid top. Furthermore, structural members 27*b* provide lands upon which seal sections 29 can act. Moreover, the membrane valve, being essentially a single valve which is centrally supported, may be rigidly affixed to the piston with four screws, thereby avoiding the addition of significant weight to the piston.

Advantageously, the top of piston 12 is also formed with a solid sector 46, as shown in FIG. 3*a*, providing a spacing width between charging passages 26 at least equal to the width of exhaust port 22. Accordingly, piston 12 is positioned within the cylinder such that solid sector 46 is adjacent exhaust port 22 so that the incoming charge is prevented from escaping through port 22. Thus, the incoming flow travels upwardly and outwardly toward the cylinder walls, away from the exhaust port, to circulate the cylinder so that it will "reach" exhaust port 22 only after it has driven substantially all of the burned gases out of upper chamber 10*a*, and has thereby filled it with a fresh charge of combustion constituents with substantially negligible loss thereof through the exhaust port.

Figure 4:
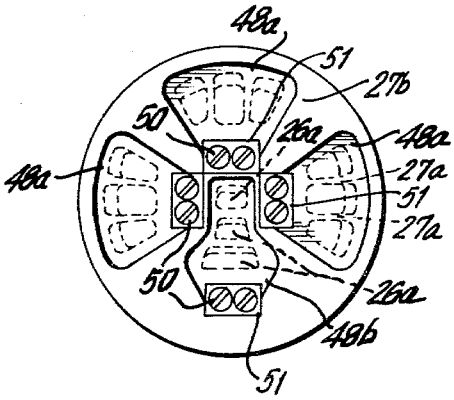
FIG. 4 is a top view of a piston head and valve assembly according to another embodiment of the present invention.

Alternatively, as shown in FIG. 4, another particularly useful embodiment of membrane valve 28 according to the present invention may comprise a plurality of totally independent single-layer radially extending flap valve sections 48*a*. Each section is formed of a substantially resilient material and secured to the top of the piston by mounting plates 51 and screws 50, forming several cantilevered valves whose free ends control a group of charging passages 26 substantially as described with reference to FIGS. 3*a–b*. The use of screws to fasten the valves to the piston is particularly useful since it enables easy replacement of worn-out or fatigued valves. Furthermore, screws can better withstand the high temperatures generated in the cylinder than such other conventional fastening means as welding or soldering.

Advantageously, the piston according to this configuration can be provided with an additional set of charging passages 26*a*, as shown in FIG. 4. This set of passages is controlled by another single member flap valve, 48*b*, appropriately shaped to fit within the space defined by the base portions of the other valve members 48*a*. Valve 48*b* is formed similar to valve member 48*a* and rigidly affixed to the piston by mounting plate 51 and screws 50 so that its free end opens away from exhaust port 22 in order to achieve the advantages described above with reference to solid sector 46. Charging passages 26*a* provide additional conduits for feeding fresh air or air/fuel mixture into upper portion 10*a* of the cylinder to ensure that the combustion chamber is properly charged for efficient operation, especially at high speed or high compression. Furthermore, the combination of mounting plates 51 with single layered valve members 48*a* and 48*b* do not add significant weight to piston 12.

Figure 5A:
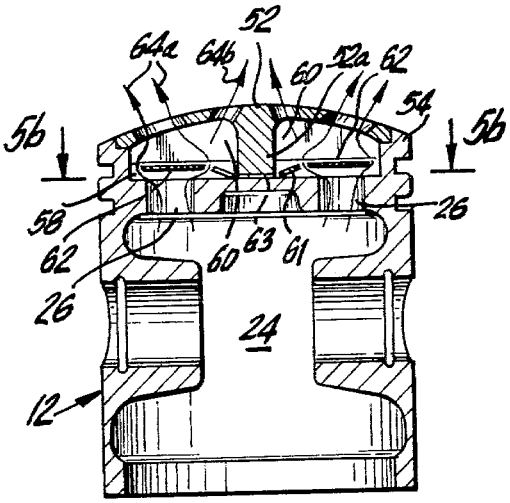
FIGS. 5*a–d* are various views of a piston assembly according to yet another embodiment of the present invention.
Figure 5C:
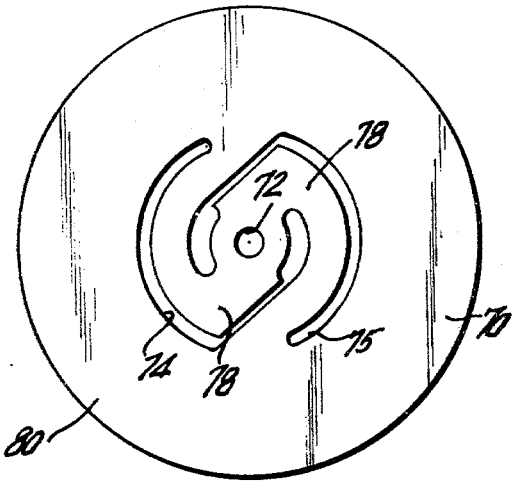
Figure 5B:
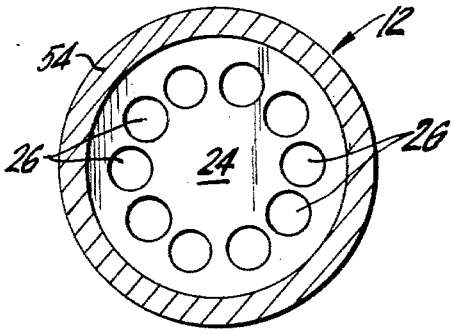
Figure 5D:
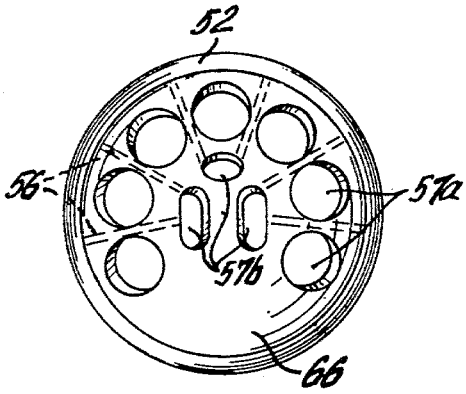

Referring now to FIGS. 5*a–d*, there is shown a piston assembly according to another aspect of the present invention. Piston 12 is provided with removable piston head 52 which fits within flanges 54 formed on piston 12. Unlike the embodiments described with reference to FIGS. 3*a* and 4, charging passages 26 may extend circumferentially around the central axis of the piston as shown in FIGS. 5*a–b* and may be essentially parallel to the piston axis, without any angular slant. Piston head 52 is formed with dispersing space 58 defined between the top of the piston 12 and the bottom of piston head 52. Piston head 52 is also formed with holes 57*a* circumferentially about its center and holes 57*b* substantially near its center. Radially extending rib members 60 are located between holes 57*a* and formed on the underside of head 52, extending into dispersing space 58 to define a substantially common plane along their lower edges which are spaced about ¼ inch from the top of piston 12. Piston head 52 is secured to the piston by convenient means, preferably screws, with a flat, single-layer, generally flexible, circular membrane valve 62 fastened at portion 63 and hinged at 61 between trunk 52*a* of piston head 52 and the upper surface of piston 12. Thus, rib members 60 restrict the movement of valve 62.

Advantageously, head 52 may be formed with a domed upper surface in which dispensing ports 57*a* may be formed on an angularly outward slant to direct the incoming flow both upwardly and outwardly toward the walls of upper cylinder 10*a*. Also advantageously, ports 57*b* may be formed with an angularly inward slant but outwardly away from exhaust port 22. Furthermore, head 52 may also be formed with solid sector 66 positioned adjacent exhaust port 22 to prevent the incoming flow from being directed into the exhaust as explained above with reference to FIG. 3*a*. Advantageously, the width of solid sector 66 separating adjacent ports 57*a* may be at least equal to the width of exhaust port 22. Thus, with the radially outward slant of ports 57*a* and 57*b* and the solid sector 66, entering flow from lower cylinder 10*b* circulates the entire upper cylinder 10*a* to drive out substantially all the burned gases contained therein with substantially negligible losses of the incoming fresh charge.

Referring now to FIG. 5*c*, there is shown a particularly useful single-layer membrane valve 62 according to this aspect of the present invention. The valve is formed from a substantially circular disc 70 adapted to accommodate attachment to the piston 12, as, for example, by a screw inserted through opening 72. The valve is also formed with cut-outs 74 and 75 overlapping each other and surrounding the center of the disc to form a flexible "donut" valve which is highly sensitive to slight variations in pressure and offers little resistance to the incoming charge. Advantageously, cuts 74 and 75 are C-shaped as shown in FIG. 4*c*, generating substantially S-shaped "hinge" section 78 and an outer, generally donut-shaped, valve member 80.

In operation, as the piston is driven downwardly on its power stroke and the pressure in lower cylinder 10*b* exceeds that in upper cylinder 10*a*, the incoming charge is forced through passage 24 and charging ports 26. Since membrane valve 62 offers no appreciable resistance to the flow of the mixture, outer valve member 80 is immediately forced upwardly under the influence of the greater pressure from below, rising within dispersing space 58 until it abuts the bottoms of radial rib members 60, as shown in FIG. 5*a*. The incoming charge flows around the outer edges of the valve member 80 and through cut-outs 74 and 75 which have been expanded due to the rising of valve member 80. Thus, flow around member 80 generally flows through ports 57*a* while flow through cut-outs 74 and 75 generally flows through both ports 57*a* and 57*b* as indicated by arrows 64*a* and 64*b* in FIG. 5*a*.

Just after the piston has reached the lower deadpoint and the pressures in the two cylinder portions 10*a* and 10*b* are in substantial equilibrium, the piston begins rising, generating a slightly greater pressure in cylinder 10*a*. Membrane valve 80 is thereby closed onto the top of the piston 12, sealing off openings 26 substantially at the beginning of the return stroke. Thus, the membrane valve according to this aspect of the present invention is particularly useful in that, since it is highly sensitive to pressure differences, there is little stress placed on the hinge portions 78, allowing a substantially long life of the valve.

The two-cycle engine according to the present invention can be adapted for use in large engines such as diesel engines used aboard marine vessels. According to this aspect of the present invention, shown in FIGS. 6*a* and 6*b*, a substantially elongated piston assembly 82 is positioned slidably within engine cylinder 84 and provided with sealing rings 86 near both its top and bottom sections. Both cylinder 84 and piston assembly 82 are lengthened to accommodate the linear motion necessary to impart a driving torque to the crankshaft assembly and to provide adequate intake of air for the relatively high compression. The cylinder may be separated from the crankcase and crankshaft assembly by wall 88, provided with sealing assembly 89 to seal off cylinder 84 from crankcase 85. Sealing assembly 89 may be any conventional structure for accommodating both the substantially vertical and the slightly lateral motions of piston shaft 90 as it acts upon the crankshaft.

Piston assembly 82 comprises piston head 82*a* and piston skirt 82*b*, both in sealing engagement with the walls of cylinder 84. The length of the piston assembly 82 is equal to about one half the length of the cylinder 84. Cylinder 84 is formed with one or more intake ports 92 in its walls slightly below its midline, and with exhaust ports 94 in its walls slightly above the midline of the cylinder. Advantageously, these two ports are positioned such that at the lower deadpoint of piston 82, the top of the piston head is just below the bottom of each exhaust port 94 and at the upper deadpoint, the bottom of the piston skirt 82*b* is just above the top of each inlet port 92. Thus, the piston assembly seals off both the intake and the exhaust ports during most of each stroke to prevent undesirable losses of the fresh charge.

Figure 6B:
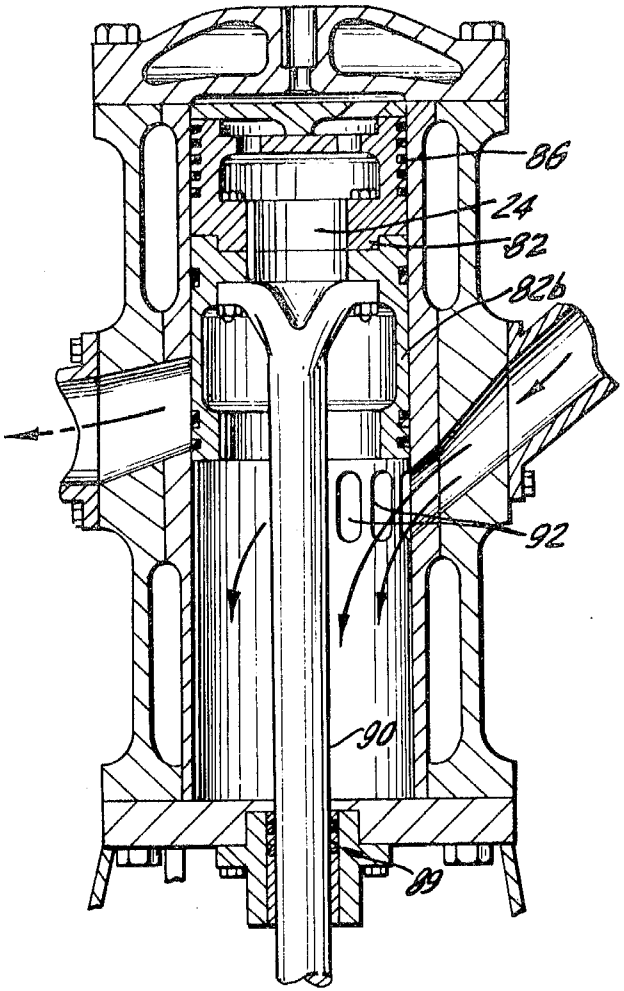
FIGS. 6*a–b* are side views of one embodiment of the present invention adapted for use in large engines.

As the piston rises from its lower deadpoint, a vacuum is generated in the lower half of the cylinder, generally as described with reference to FIGS. 1*a–c*. Piston head 82*a* closes off the exhaust port 94 to seal off the upper half of cylinder 84 and begin compressing the gases therein. As piston head 82*a* reaches its upper deadpoint, the piston skirt 82*b* exposes intake ports 92 (as shown in FIG. 6*b*) when the vacuum has reached substantially its greatest value. Air (in the case of diesel engines) or a fuel/air mixture (for electrically ignited engines) is immediately drawn into and fills and lower half of cylinder 84, from any suitable source, such as air filter 96.

Essentially simultaneously, the piston assembly 82 is reaching its upper deadpoint and gases in the upper half of cylinder 84 are compressed to their maximum density. Thus, when the piston 82 reaches its upper deadpoint, diesel fuel (in the case of a diesel engine) or an electrical spark (in the case of electrically ignited engines) is introduced into the compressed gases at which time the charge ignites, forcing piston assembly 82 downwardly. The piston skirt 82*b* quickly closes intake ports 92 and the downward motion of the piston compresses the air or fuel/air mixture in the lower cylinder substantially as described with reference to FIGS. 1*a–c*.

Thus, as the piston assembly 82 travels downwardly, a point is reached where the pressures in the upper and lower halves of cylinder 84 are in substantial equilibrium. At this point, the air or air/fuel mixture compressed in the lower half of cylinder 84 is forced through piston passage 24, opening membrane valve 96 which may comprise any of the valve assemblies discussed with reference to FIGS. 2–5. When the piston nears its lower deadpoint, exhaust ports 94 are exposed and the burned gases in the upper half of cylinder 84 escape through exhaust passage 98. As explained generally with reference to FIGS. 1–5, the incoming flow enhances evacuation of burned gases from the upper half of cylinder 84 by driving them out through the exhaust ports 94 shown by arrows 100. The upper portion of the cylinder is therefore substantially filled with fresh air or air/fuel mixture when the compression cycle begins again.

Figure 7:
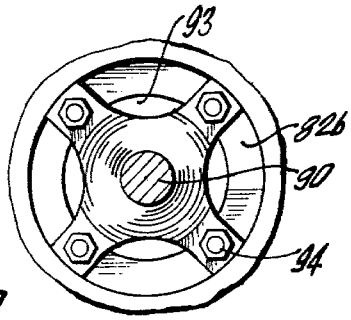
FIG. 7 is a view taken along section 7—7 of FIG. 6*a*.
Figure 6A:
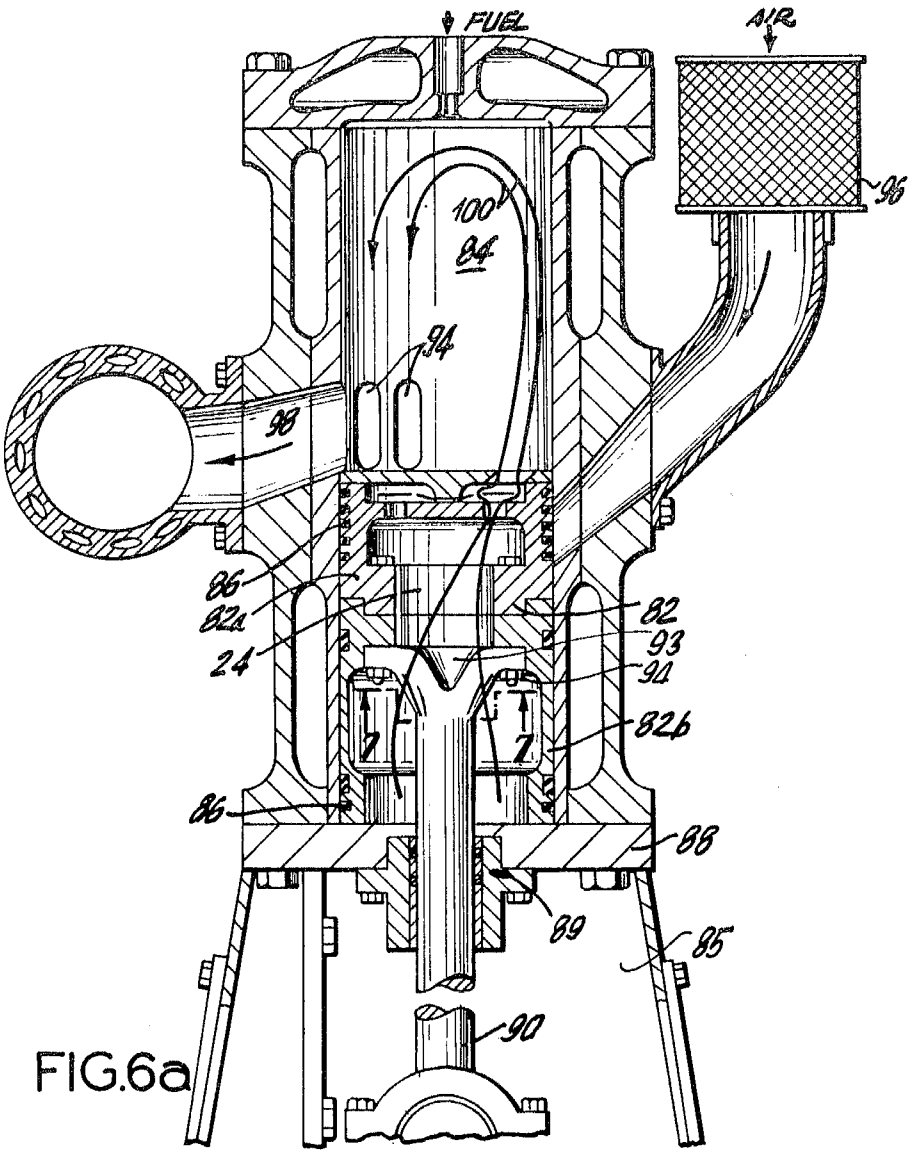

Shaft 90 may be connected to piston assembly 82 by any convenient means whereby access is provided for the compressed charge in the lower cylinder to pass through the piston and into the upper cylinder. Advantageously, shaft 90 may be formed with a two-armed connector (as shown in FIG. 6*a*) or a four-armed connector (as shown in FIG. 7), having intake passages 93 to allow air and/or fuel free access to upper piston cavity 24. Thus, shaft 90 may be attached to the bottom of piston 82 by any convenient means, such as by bolts 94.

Advantageously, the membrane valve system used in such engines as shown in FIGS. 6*a–b* may be any of those described with reference to FIGS. 5*a–d*. However, if the engine operates according to the diesel principle, piston head 52 may advantageously be formed with a substantially flat top and dispensing ports 57*a* and 57*b* may be formed with a radially outward slant such that incoming flow 100 is directed away from exhaust ports 94. Accordingly, piston 82 may travel high within cylinder 84 as shown in FIG. 6*b*, to generate the high compression required by diesel engines.

This aspect of the present invention is particularly useful when employed by two-cycle engines of large power plants such as marine engines, since it provides an unusually simple two-cycle engine which requires much less valuable space than currently used engines. Moreover, large engines utilizing the present invention are much less complicated—and therefore less expensive—to fabricate, assemble and maintain. Furthermore, currently used large two-cycle engines, particularly those adapted for marine application, require very expensive turbo blowers activated by the escaping exhaust to force feed air into the cylinder in order to generate the required compression. However, the present invention obviates the need for such expensive, space consuming and power reducing apparatus. Accordingly, large engines according to the present invention require less space, are less expensive, "steal" less power and are less susceptible to break-down than any heretofore known.

It will be appreciated by those skilled in the art that certain modifications can be made in the two-cycle engine as described above without departing from the spirit and scope of the invention as defined in the appended claims.

What is claimed is:

1. A piston assembly for use in an internal combustion two-cycle engine which has an exhaust port and an intake port, comprising:

a piston having a top and a sidewall structure depending therefrom to define a generally open-bottom hollow cavity;

means formed on said piston for pivotally connecting a piston rod thereto;

at least one charging passage formed in said top, each said charging passage extending through said top to communicate with said hollow cavity; and generally resilient pressure sensitive valve means mounted to the top surface of said piston, said valve means including a free end portion positioned for controlling flow through at least one said charging passage, said free end portion adapted to deflect upwardly in response to a greater pressure in said hollow cavity than from above said valve means to allow flow of a fluid-like charge from said hollow cavity through each charging passage said free end portion controls, yet substantially preventing flow through each said charging passage it controls when pressure in said hollow cavity is generally not greater than that above said valve means.

2. A piston assembly according to claim 1, wherein each said charging passage is formed with a generally angularly outward slant, sloping radially outwardly from said hollow cavity to said top to direct said flow radially outwardly.

3. A piston assembly according to claim 2, wherein said piston includes at least one group of relatively small passages extending through said piston top, the passages in each said group being positioned in generally close proximity with one another, said free end portion of said valve means adapted to interrupt flow through a said group of charging passages.

4. A piston assembly according to claim 3, wherein said piston is formed with at least two said groups of charging passages, said groups being generally spaced from each other and located in a radially outer circumferential zone of said piston top, said top including a solid sector spacing two of said groups by a distance at least equal to the width of the exhaust port in the engine in which said piston is intended for use, and wherein said valve means comprises a first single-layer valve member mounted to said piston top, said valve member including a number of generally independent flap-like valve sections integrally connected at a generally central point, the number of said valve sections being equal to the number of said groups, said valve member mounted to said piston top such that each said valve section controls flow through one of said groups with its free end opening substantially radially outwardly to direct substantially all of said flow radially outward and away from said solid sector.

5. A piston assembly according to claim 4, wherein said valve means further includes a plurality of successively smaller single-layer valve members proportioned generally identical to said first valve member, said successively smaller valve members mounted on top of said first valve member in order of decreasing size to form a generally resilient leaf-spring valve attached to said piston top.

6. A piston assembly according to claim 5, wherein said valve members are made from a generally circular sheet of resilient material, having relatively thin cut-out portions extending from the outer edge of the sheet generally radially inwardly toward its center, said valve sections resembling a somewhat clover-leaf configuration.

7. A piston assembly according to claim 6, wherein said leaf-spring valve is formed with at least four apertures generally at its center to receive screws for connection to said piston top, and wherein said piston top is provided with threaded holes adapted to receive said screws such that said valve is affixed in generally cantilever fashion to the center of said top.

8. A piston according to claim 3, wherein said piston is formed with at least two first groups of said small charging passages, said first groups being generally spaced from each other and located in a radially outer circumferential zone of said piston top, said top including a sector spacing two of said first groups by a distance at least equal to the width of the exhaust port in the engine in which said piston is intended for use, said sector being formed with at least one additional charging passage having an angular slant generally away from the outer edge of said sector, and wherein said valve means includes a generally independent first flap-like valve member for each said first group of passages, each said first flap-like valve member mounted to said piston top for controlling flow through one of said first groups of passages, the number of said first flap-like valve members being equal to the number of said first groups, each said first flap-like valve member comprising at least one substantially thin layer of generally resilient material mounted at one end to said piston top, the mounted ends of all said first valve members generally surrounding all said additional charging passages and the free end portion of each said valve member opening generally radially outwardly, said valve means further including an additional flap-like valve member for controlling all said additional charging passages, said additional valve member being shaped to fit within the space defined by the mounted portions of said first valve members and affixed at one end generally at the outer peripheral edge of said sector on said piston, with its free end opening away from said edge to control flow through said additional charging passages and to direct such flow generally away from said sector.

9. An improved internal combustion two-cycle engine having an engine block which encloses a crankcase adjacent at least one engine cylinder having at least one exhaust port in its upper portion and containing a piston assembly which is slidable within said cylinder and pivotally connected by a connecting rod assembly to a crankshaft rotatably mounted in said crankcase for translating linear travel of the piston to rotation of the crankshaft, each said piston assembly partitioning its corresponding engine cylinder into a generally upper cylinder portion and a generally lower cylinder portion, wherein the improvement comprises:

at least one intake port formed in each said lower cylinder portion, each said intake port controlled by the piston to allow a fresh charge of any desired combustion constituents to be drawn into said lower cylinder portion during each return stroke of the piston;

at least one charging passage extending through each said piston to provide communication between the lower cylinder portion and the upper cylinder portion provided by the piston; and generally resilient pressure sensitive valve means mounted to the top of each said piston, said valve means having a free end portion positioned for controlling flow through at least one said charging passage, said free end portion adapted to deflect upwardly in response to a greater pressure in said lower cylinder portion than in said upper cylinder portion to permit flow of a fresh charge of combustion constituents from said lower cylinder portion into said upper cylinder portion, yet substantially preventing flow into the said upper cylinder portion when pressure in said lower cylinder portion is generally not greater than that in said upper cylinder portion.

10. An improved engine according to claim 9, wherein each said charging passage is formed with a generally angularly outward slant, sloping radially outwardly from said lower cylinder to said upper cylinder portion for directing said flow radially outwardly towards the walls of said upper cylinder portion and generally away from said exhaust port.

11. An improved engine according to claim 10, wherein said piston includes at least one group of relatively small charging passages extending through its top, the passages in each said group being positioned in generally close proximity with one another, a said free end portion of said valve means adapted to control flow through a said group of charging passages.

12. An improved engine according to claim 11, wherein said piston is formed with at least two said groups of said small charging passages, said groups being generally spaced from each other and located in a radially outer circumferential zone on the top of the piston, the piston top including a solid sector spacing two of said groups by a distance at least about equal to the width of said exhaust port, and wherein said valve means comprises a first single-layer valve member mounted to said piston top, said valve member including a number of generally independent flap-like valve sections integrally connected at a generally central point, the number of said valve sections being equal to the number of said groups, said valve member mounted to said piston top such that each said valve section controls flow through all the passages in one of said groups with its free end opening substantially radially outwardly of said piston to direct the flow radially outwardly towards said upper cylinder walls and away from said exhaust port.

13. An improved engine according to claim 12, wherein said valve means further include a plurality of successively smaller single-layer valve members proportioned generally identical to said first valve member, said successively smaller valve members mounted on top of said first valve member in order of decreasing size to form a generally resilient leaf-spring valve attached to the top of the piston.

14. An improved engine according to claim 13, wherein said valve members are made from a generally circular sheet of resilient material, having relatively thin cut-out portions extending from the outer edge of the sheet generally radially inwardly toward its center, said valve sections resembling a somewhat clover-leaf configuration.

15. An improved engine according to claim 13, wherein said leaf-spring valve is formed with at least four apertures generally at its center to receive screws for connection to said piston top, and wherein said piston top is provided with threaded holes adapted to receive said screws such that said valve is affixed in generally cantilever fashion to the center of said piston top.

16. An improved engine according to claim 11, wherein said piston is formed with at least two first groups of said small charging passages, said first groups of charging passages being generally spaced from each other and located in a radially outer circumferential zone of said piston top, said top including a sector spacing two of said first groups by a distance at least about equal to the width of said exhaust port, said sector being formed with at least one additional charging passage having an angular slant away from the outer edge of said sector, and wherein said valve means includes a generally independent first flap-like valve member for each said first group of passages, each said first flap-like valve member mounted to the piston top for controlling flow through one of said first groups of charging passages, the number of said first flap-like valve members being equal to the number of said first groups, each said first flap-like valve member comprising at least one substantially thin single layer of generally resilient material mounted at one end to said piston top, the mounted ends of all said first valve members generally surrounding all said additional charging passages and the free end portion of each said valve member opening generally radially outwardly, said valve means further including an additional flap-like valve member for controlling all said additional charging passages, said additional valve member being shaped to fit within the area defined by the mounted portions of said first valve members and affixed at one end generally at the outer peripheral edge of said sector on said piston, with its free end opening away from said edge to control flow through said additional charging passages and to direct such flow generally away from said exhaust.

17. An improved internal combustion two-cycle engine having an engine block which encloses a crankcase adjacent at least one engine cylinder having at least one exhaust port in its upper portion and containing a piston assembly which is slidable within said cylinder and pivotally connected by a connecting rod assembly to a crankshaft rotatably mounted in said crankcase for translating linear travel of the piston to rotation of the crankshaft, each said piston assembly partitioning its corresponding engine cylinder into a generally upper cylinder portion and a generally lower cylinder portion which is adjacent the crankcase, wherein the improvement comprises:

at least one intake port formed in said crankcase and coupled to a source of any desired combustion constituents;

pressure sensitive intake valve means mounted in said crankcase for controlling flow through said intake port, said intake valve means opening said intake port to allow a fresh charge of said combustion constituents to be drawn into said crankcase during each return stroke of said piston and closing said intake port during each power stroke of said piston;

at least one charging passage extending through each said piston to provide communication between the lower cylinder portion and the upper cylinder portion provided by the piston; and generally resilient pressure sensitive valve means mounted to the top of each said piston, said valve means having a free end portion positioned for controlling flow through at least one said charging passage, said free end portion adapted to deflect upwardly in response to a greater pressure from below said pressure sensitive valve than from above, to permit flow of a fresh charge of combustion constituents into said upper cylinder portion, yet substantially preventing flow into said upper cylinder portion when pressure below said pressure sensitive valve does not generally exceed that from above.

18. An improved engine according to claim 17, wherein each said charging passage is formed with a generally angularly outward slant, sloping radially outwardly from said lower cylinder to said upper cylinder portion for directing said flow radially outward towards the walls of said upper cylinder and generally away from said exhaust port.

19. An improved engine according to claim 18, wherein said piston includes at least one group of relatively small charging passages extending through its top, the passages of each said group being positioned in generally close proximity with one another, a said free end portion of said valve means adapted to control flow through a said group of charging passages.

20. An improved engine according to claim 19, wherein said piston is formed with at least two said groups of said small charging passages, said groups being generally spaced from each other and located in a radially outer circumferential zone on the top of said piston, the piston including a solid sector spacing two of said groups by a distance at least about equal to the width of said exhaust port, wherein said valve means comprises a first single-layer valve member mounted to said piston top, said valve member including a number of generally independent flap-like valve sections integrally connected at a generally central point, the number of said valve sections being equal to the number of said groups, said valve member mounted to said piston top such that each said valve section controls flow through all the passages in one of said groups with its free end opening substantially radially outwardly of said piston to direct said flow radially outward towards said upper cylinder walls and away from said exhaust port.

21. An improved engine according to claim 20, wherein said valve means further include a plurality of successively smaller single-layer valve members proportioned generally identical to said first valve member, said successively smaller valve members mounted on top of said first valve member in order of decreasing size to form a generally resilient leaf-spring valve attached to the top of the piston.

22. An improved engine according to claim 21, wherein said valve members are made from a generally circular sheet of resilient material, having relatively thin cut-out portions extending from the outer edge of the sheet generally radially inwardly toward its center, said valve sections resembling a somewhat clover-leaf configuration.

23. An improved engine according to claim 21, wherein said leaf-spring valve is formed with at least four apertures generally at its center to receive screws for connection to said piston top, and wherein said piston top is provided with threaded holes adapted to receive said screws such that said valve is affixed in a generally cantilever fashion to the center of said piston top.

24. An improved engine according to claim 19, wherein said piston is formed with at least two first groups of said small charging passages, said first groups of passages being generally spaced from each other and located in a radially outer circumferential zone of said piston top which includes a sector spacing two of said first groups by a distance at least about equal to the width of said exhaust port, said sector being formed with at least one additional charging passage having an angular slant away from the outer edge of such sector, and wherein said valve means includes a generally independent first flap-like valve member for each said first group of passages, each said first flap-like valve member mounted to the piston top for controlling flow through one of said first groups of charging passages, the number of said first flap-like valve members being equal to the number of said first groups, each said first flap-like member comprising at least one substantially thin layer of generally resilient material mounted at one end to said piston top, the mounted ends of all said first valve members generally surrounding all said additional charging passages and the free end portion of each said flap-like valve member opening generally radially outwardly, said valve means further including an additional flap-like valve member for controlling all said additional charging passages, said additional valve member being shaped to fit within the area defined by the mounted portions of said first valve members and affixed at one end generally at the outer peripheral edge of said sector on said piston, with its free end opening away from said edge to control flow through said additional charging passages and to direct such flow generally away from said sector.

* * * * *